US005724692A

United States Patent [19]

Zhadanov et al.

[11] Patent Number: 5,724,692

[45] Date of Patent: Mar. 10, 1998

[54] DEVICE FOR WASHING HOLLOW ARTICLES

[76] Inventors: Sam Zhadanov; Eli Zhadanov, both of 1120 E.Linden Ave., Linden, N.J. 07036

[21] Appl. No.: 660,154

[22] Filed: Jun. 3, 1996

[51] Int. Cl.[6] ..... B08B 9/20

[52] U.S. Cl. ..... 15/69; 15/59; 15/65

[58] Field of Search ..... 15/59, 65–67, 15/69, 73–76; 134/169 R, 191; 285/65, 67, 81; 403/337, 340

[56] References Cited

U.S. PATENT DOCUMENTS

| | | | |
|---|---|---|---|
| 212,841 | 3/1879 | Dillin | 15/69 |
| 1,462,598 | 7/1923 | Grenzke | 15/69 |
| 1,876,895 | 9/1932 | Fleming | 15/69 |
| 2,019,705 | 11/1935 | Hubert | 15/69 |
| 2,204,392 | 6/1940 | Arm | 285/81 |
| 3,121,897 | 2/1964 | Lambrich | 15/69 |
| 4,574,414 | 3/1986 | Zhadanov | 15/74 |

*Primary Examiner*—Terrence Till
*Attorney, Agent, or Firm*—Ilya Zborovsky

[57] ABSTRACT

A device for washing hollow objects comprises a hollow housing forming an inner chamber, a rotor rotatable in the chamber under the action of water, a connection for connecting the rotor to a working instrument for washing an object, a water inlet and water outlet for supplying water into the chamber and withdrawing at least a part of water from the chamber, the water inlet and the water outlet being formed as a water inlet nozzle and a water outlet nozzle arranged coaxially with one another.

8 Claims, 3 Drawing Sheets

DEVICE FOR WASHING HOLLOW ARTICLES

BACKGROUND OF THE INVENTION

The present invention relates to a device for washing hollow articles having surfaces which are difficult to access, for example bottles, deep glasses, baby bottles of various shapes, pacifiers, jewelry, etc.

Devices for washing articles which are attachable to a kitchen faucet are known in the art. One such device is disclosed in my U.S. Pat. No. 4,574,414. This device has a passage for supplying water, and a rotor located in the path of water and rotatable under the action of water so that it also rotates a washing member, for example a brush member for washing the articles. This device can be further improved.

SUMMARY OF THE INVENTION

Accordingly, it is an object of the present invention to provide a device for washing articles of the above-mentioned general type which is a further improvement of the existing devices of this type.

In keeping with these objects and with others which will become apparent hereinafter, one feature of the present invention resides, briefly stated, in a device for washing articles which has a rotor, a chamber in which said rotor rotates under the action of water, an water inlet leading toward the interior of the chamber, and an outlet leading from the interior of the chamber outwardly, wherein the water inlet and the water outlet are located coaxial with one another.

When the device is designed in accordance with the present invention with the coaxial arrangement of the water inlet and the water outlet, a resistance to water is reduced which, in combination with the vortex produced in the chamber, increases the torque of the rotor and therefore increases the efficiency of washing by the washing member attached to the rotor.

In accordance with another feature of the present invention, the vanes of the rotor are arranged at an angle of 45° toward the water outlet. Therefore it contributes to more efficient ejection of water so as to form a rarification at the outlet, which in turn increases the speed and the torque.

In accordance with still a further feature of the present invention, the rotor is located concentrically in the water chamber, and therefore a maximum turning moment which increases the fact of vortex is provided.

Still another feature of the present invention is that the working tools are removably connectable with the housing of the device by means of toothed connections which are self-locked when they are turned. On the other hand, in response to the reverse turning, the tools can be easily removed from the housing.

Finally, the washing solution is supplied into an intermediate zone, from which it is finally delivered to the surface to be washed by an individual working tool.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
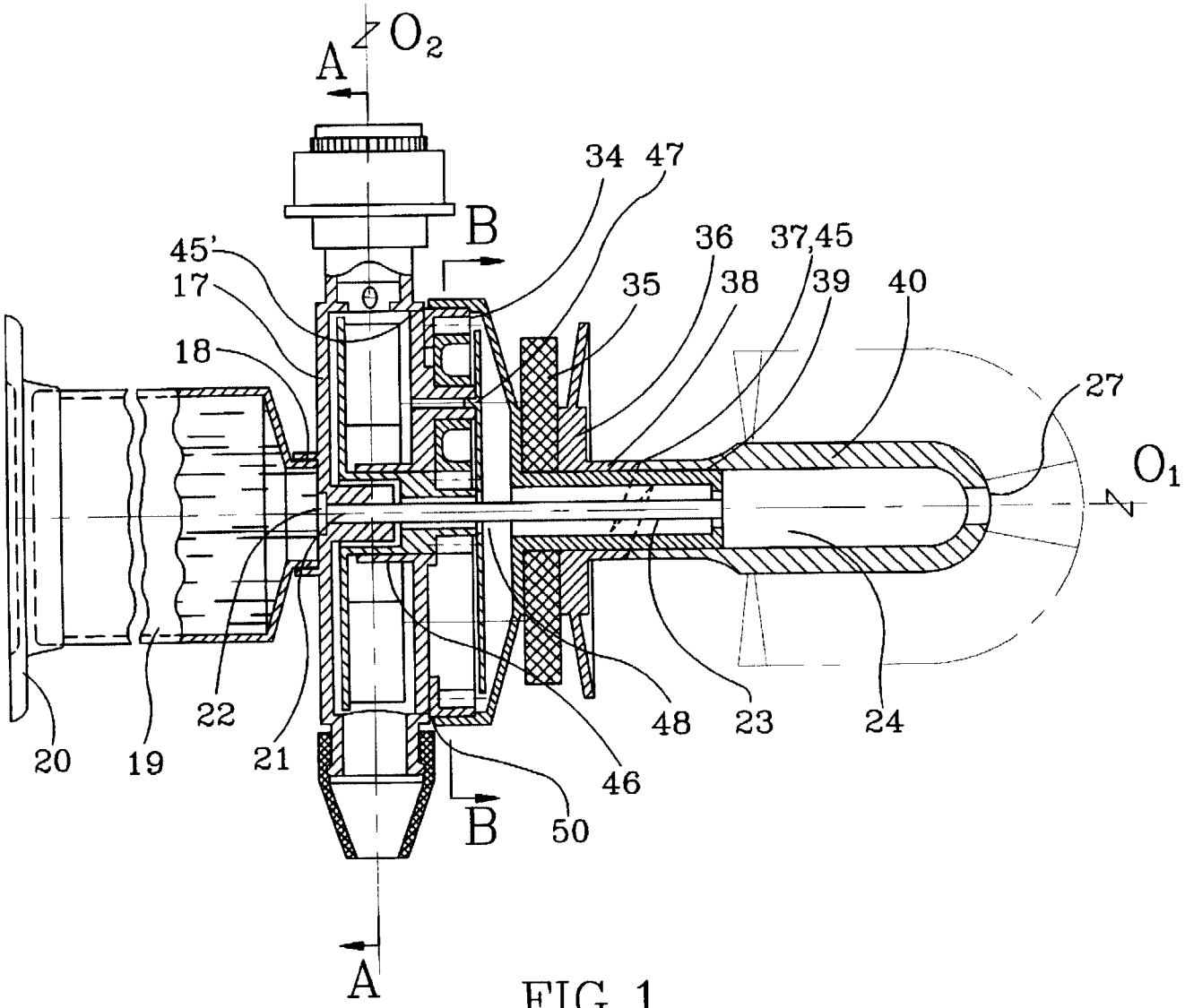
FIG. 1 is a view showing a section of the device for washing in accordance with the present invention.
Figure 3:
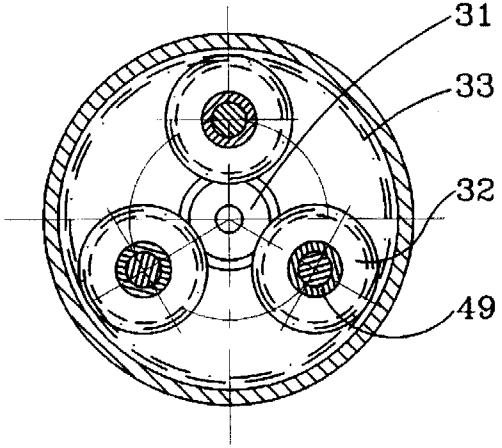
FIG. 3 is a view showing a section of a gear transmission associated with the rotor of the inventive washing device.
Figure 2:
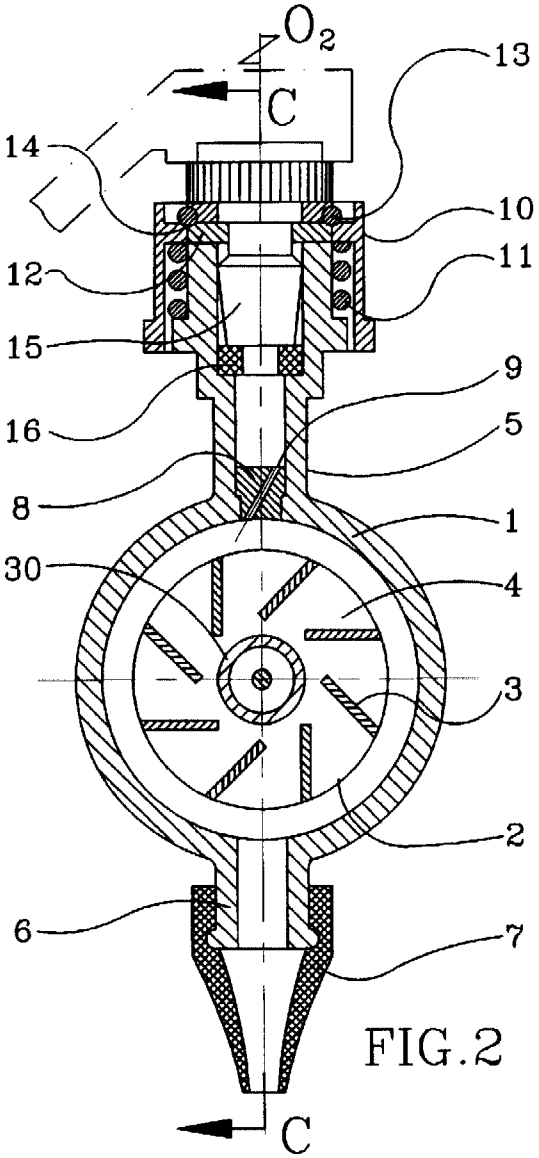
FIG. 2 is a view showing the inventive device in a section taken perpendicular to the plane of the drawings of FIG. 1, through a water chamber and a rotor of the device.

A device for washing hollow articles in accordance with the present invention has a hollow body which is identified with reference numeral 1 in FIGS. 1 and 2. Its upper part is provided with a water inlet nozzle 5 extending along an axis $0_2$, while its lower part has a water outlet nozzle 6 extending along the same axis. The water inlet nozzle and the water outlet nozzle are coaxial with one another, or in other words they extend along the same axis which also extends through a center of a rotor as will be explained hereinbelow. A bushing 8 is arranged inside the water inlet nozzle and has an inclined opening 9. The upper part of the water inlet nozzle 5 has a quickly disconnectable connecting unit with an outer ring 10, a spring 11, three inserts 12 located in openings of the nozzle 5, and a locking ring 13 arranged in an annular groove 14. A connection of the device to a water faucet is performed through a bushing 15 and sealed with a rubber ring 16. The water outlet nozzle 6 can be provided with an attachment 7 having different shapes.

Figure 4:
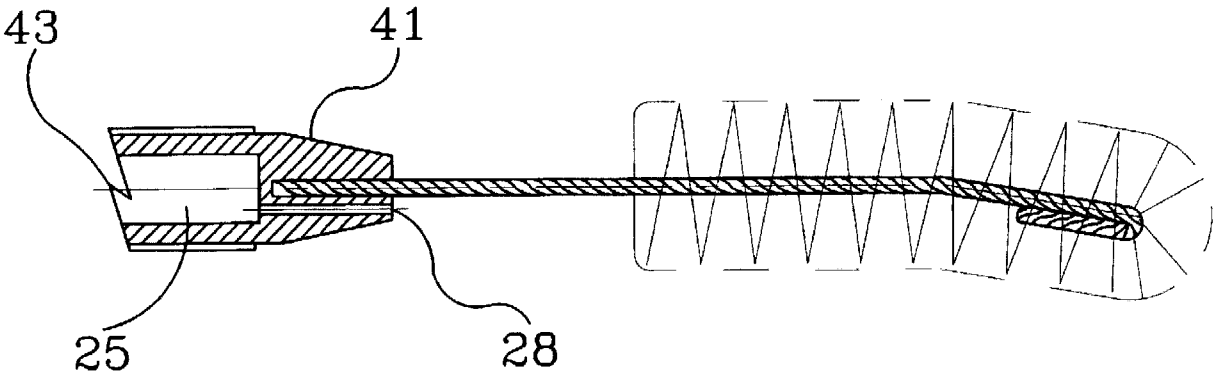
FIGS. 4 and 5 are two different tools which are removably attachable to the inventive device for washing baby bottles and for washing pacifiers and jewelry, correspondingly.
Figure 5:
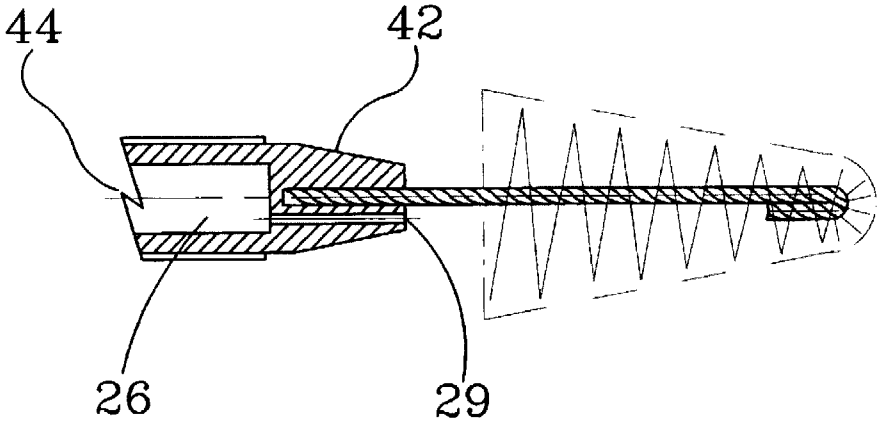

The rear wall 17 of the body 1 has a threaded collar 18, and a container 19 is threaded into the collar. The bottom of the container 19 has a supporting plate 20, to support the device on a surface in a standing position. The container accommodates a solution, for example a salt solution, and is composed of an elastic plastic material. Therefore, it can be squeezed so as to pump an intermediate zone I and then into a solution into the working zone w of the device. The inner surface of the wall 17 of the body 1 is provided with an axle 21 with an opening 22. A plastic pipe extends through the opening 22 and supplies the washing solution into an inner space of the working tools 24, 25, 26 shown in FIGS. 1, 4 and 5. From the interior of the working tools, the washing solution exits with a water flow through openings 27, 28 and 29 directly into the working zone of the tools. As can be seen in FIG. 1, the opening 27 of the tool 24 is located centrally and coaxially with the axis of the tool. In contrast, the openings 28 and 29 of the tools 25 and 26 are laterally offset relative to the corresponding axis of the corresponding tool, so that water with the washing solution is supplied from the laterally offset zone of a hollow body of the tool into the working zone w or brushing zone [brushing member] of the tool.

The axle 21 carries a rotor 3 which is provided with vanes 3 arranged on a disk 4 and rotates in the chamber of the body 1. A hub of the rotor is hollow and ends with a gear 31 which engages with three planetary gears 32 mounted on the axles 49 of a cover 45 welded to the body 1, along a cylindrical surface 50. A limiting disk 47 with a central opening 48 is mounted on the axles 49. The gears 32 engage teeth of a ring with inner gears so as to form a planetary transmission which transmits the rotation of the rotor to the bush 34. The center of the rotor coincides with the center of the cylindrical inner chamber of the body. The vanes 3 of the rotor are inclined at an angle 45° to the outlet opening.

The bush 34 has a hollow shaft 39 which carries a sharpening member 35 and a conical disk 36 with a hub 38.

The hub 38 has an end provided with a toothed catch 37 corresponding to toothed catches 43, 44, 45 of the working tools 40, 41, 42. In order to mount a corresponding tool on the device, it suffices to place the tool coaxially with the bush 34 so that the toothed catch 37 engages the corresponding toothed catch 43, 44 or 45, and then to turn the tool. The removal of the tool is performed in a reverse order.

The operation of the device is believed to be clear. When the water is supplied through the water inlet nozzle 5 it enters the central chamber of the device and rotates the rotor 2 which in turn rotates the working tool. By squeezing the container 19, the washing solution is supplied into the working zone of the working tool to wash an object. At the same time, the water exits through the water outlet nozzle 6.

It will be understood that each of the elements described above, or two or more together, may also find a useful application in other types of constructions differing from the types described above.

While the invention has been illustrated and described as embodied in a device for washing hollow articles, it is not intend to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for washing hollow objects, comprising a working instrument; a hollow housing forming an inner chamber; a rotor rotatable in said chamber under the action of water; means for connecting said rotor to said working instrument for washing an object; water inlet and water outlet means for supplying water into said chamber and withdrawing at least a part of water from said chamber, said water inlet and said water outlet means being formed as a water inlet nozzle and a water outlet nozzle arranged coaxially with one another, wherein said chamber has an axis, said water inlet nozzle and said water outlet nozzle having a common axis coinciding with said axis of said chamber, said rotor having an axis of rotation located on said common axis.

2. A device as defined in claim 1, wherein said chamber has an axis, said rotor being coaxial with said axis of said chamber.

3. A device as defined in claim 1; and further comprising a container for accommodating a washing solution and connected with a passage communicatable with the working instrument, said container being squeezable so as to squeeze the washing solution into the working instrument.

4. A device as defined in claim 1; and further comprising means forming an intermediate zone from which the water solution is supplied to the working instrument.

5. A device as defined in claim 1; and further comprising the working instrument attachable to said rotor and having a working zone and a water outlet located coaxially with the working zone.

6. A device as defined in claim 1; and further comprising a working instrument having a working zone and a water outlet located laterally offset relative to an axis of the working zone.

7. A device as defined in claim 1, wherein said rotor has vanes which are located at an angle of substantially 45° relative to said outlet means.

8. A device for washing hollow objects, comprising a working instrument; a hollow housing forming an inner chamber; a rotor rotatable in said chamber under the action of water; means for connecting said rotor to said working instrument for washing an object; water inlet and water outlet means for supplying water into said chamber and withdrawing at least a part of water from said chamber, said water inlet and said water outlet means being formed as a water inlet nozzle and a water outlet nozzle arranged coaxially with one another, said means for connecting said rotor with said working instrument being formed as toothed catching members which are engageable with one another by turning of said working instrument relative to said rotor so as to provide engagement of said toothed catching members, and said working instrument is disengageable from said rotor by turning the working instrument in an opposite direction.

* * * * *